US012600511B2

(12) United States Patent
Marchesini et al.

(10) Patent No.: US 12,600,511 B2
(45) Date of Patent: Apr. 14, 2026

(54) APPARATUS AND METHOD FOR MOVING OBJECTS

(71) Applicant: AETNA GROUP S.P.A., Verucchio (IT)

(72) Inventors: Moris Marchesini, Verucchio (IT); Mirko Querzè, Verucchio (IT); Glauco Gavina, Verucchio (IT); Andrea Secci, Verucchio (IT)

(73) Assignee: AETNA GROUP S.P.A., Verucchio (IT)

( * ) Notice: Subject to any disclaimer, the term of this patent is extended or adjusted under 35 U.S.C. 154(b) by 48 days.

(21) Appl. No.: 18/723,671

(22) PCT Filed: Dec. 20, 2022

(86) PCT No.: PCT/IB2022/062538
§ 371 (c)(1),
(2) Date: Jun. 24, 2024

(87) PCT Pub. No.: WO2023/119154
PCT Pub. Date: Jun. 29, 2023

(65) Prior Publication Data

US 2025/0051048 A1 Feb. 13, 2025

(30) Foreign Application Priority Data

Dec. 23, 2021 (IT) ..... 102021000032423

(51) Int. Cl.
*B65B 35/44* (2006.01)
*B65B 35/24* (2006.01)
(Continued)

(52) U.S. Cl.
CPC ..... *B65B 35/243* (2013.01)

(58) Field of Classification Search
CPC ..... B65B 23/243; B65B 35/44; B65G 47/08; B65G 47/52
(Continued)

(56) References Cited

U.S. PATENT DOCUMENTS 3,687,262 A * 8/1972 Campbell ..... B65G 47/82 198/430
5,429,651 A * 7/1995 Bolin ..... B65G 47/82 198/430
(Continued)

FOREIGN PATENT DOCUMENTS

EP 1 932 782 6/2008
EP 1932782 A1 * 6/2008 ..... B65G 47/841
(Continued)

OTHER PUBLICATIONS

International Search Report issued Apr. 18, 2023 in corresponding International Application No. PCT/IB2022/062538.

*Primary Examiner* — Douglas A Hess
(74) *Attorney, Agent, or Firm* — Wenderoth, Lind & Ponack, L.L.P.

(57) ABSTRACT

A moving apparatus for objects comprises a first moving system for moving and separating in groups of a set number objects that are arranged aligned one behind the other and in contact along a first advancement direction; a second moving system arranged to receive said groups of objects from said first moving system and move them separately along a transfer direction that is inclined by an angle with respect to said first advancement direction; and a third moving system comprising at least one transfer element mobile along a second advancement direction that is transversal, in particular almost orthogonal, to said first advancement direction and arranged to abut and pick up at least one group of objects at a time from said second moving system and then move
(Continued)

along said second advancement direction the group of objects arranged in a row.

20 Claims, 5 Drawing Sheets

(51) Int. Cl.
*B65G 47/02* (2006.01)
*B65G 47/08* (2006.01)

(58) Field of Classification Search
USPC ..... 198/579, 604
See application file for complete search history.

(56) References Cited

U.S. PATENT DOCUMENTS

| | | | | |
|---|---|---|---|---|
| 7,921,983 | B2 | 4/2011 | Gimmerstam et al. | |
| 9,540,183 | B2 * | 1/2017 | Papsdorf | B65G 17/32 |
| 10,618,747 | B2 * | 4/2020 | Flammann | B65G 47/715 |
| 11,155,422 | B2 * | 10/2021 | Berger | B65G 47/5109 |
| 11,939,090 | B2 * | 3/2024 | Franzaroli | B65B 9/026 |

FOREIGN PATENT DOCUMENTS

| | | | | |
|---|---|---|---|---|
| EP | 2 316 737 | | 5/2011 | |
| EP | 2 594 513 | | 5/2013 | |
| EP | 3699099 | A1 * | 8/2020 | B65B 35/52 |
| WO | WO-9506590 | A1 * | 3/1995 | B65B 43/52 |
| WO | WO-2022214994 | A1 * | 10/2022 | B65B 35/58 |

* cited by examiner

Fig. 4
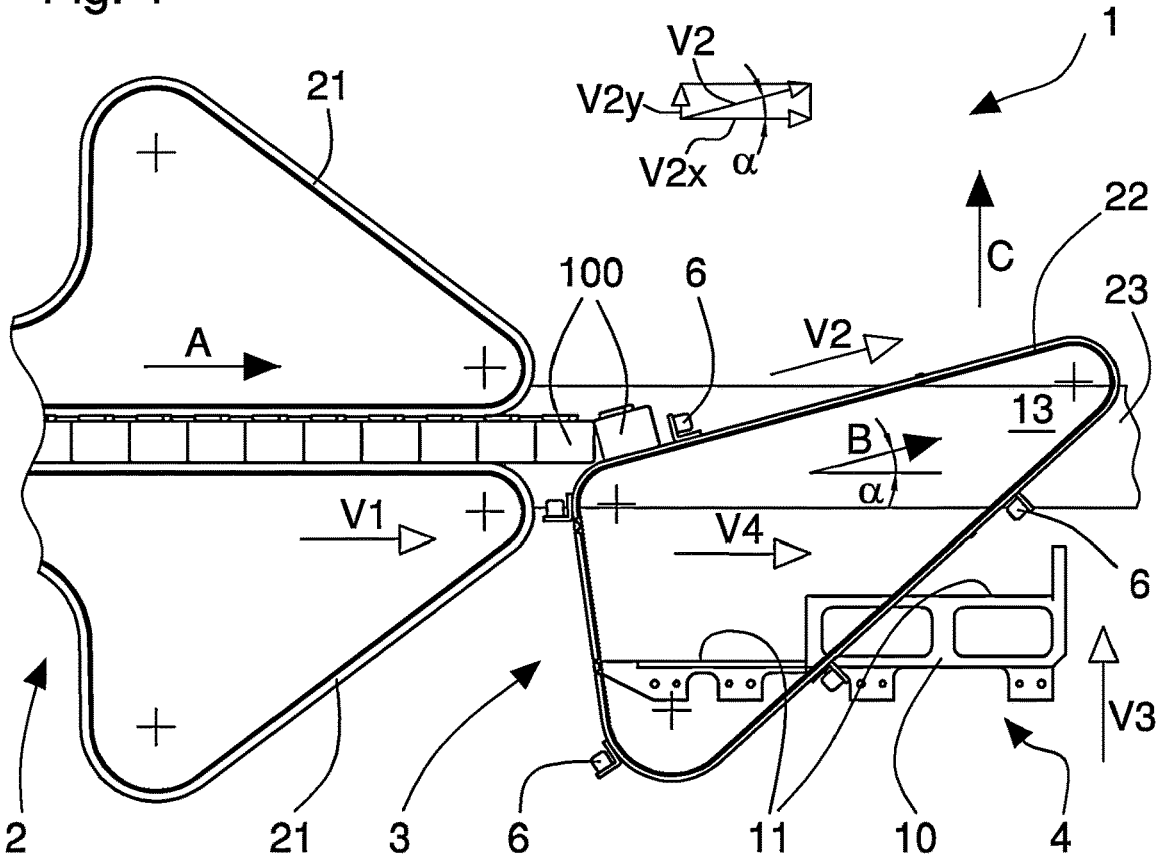
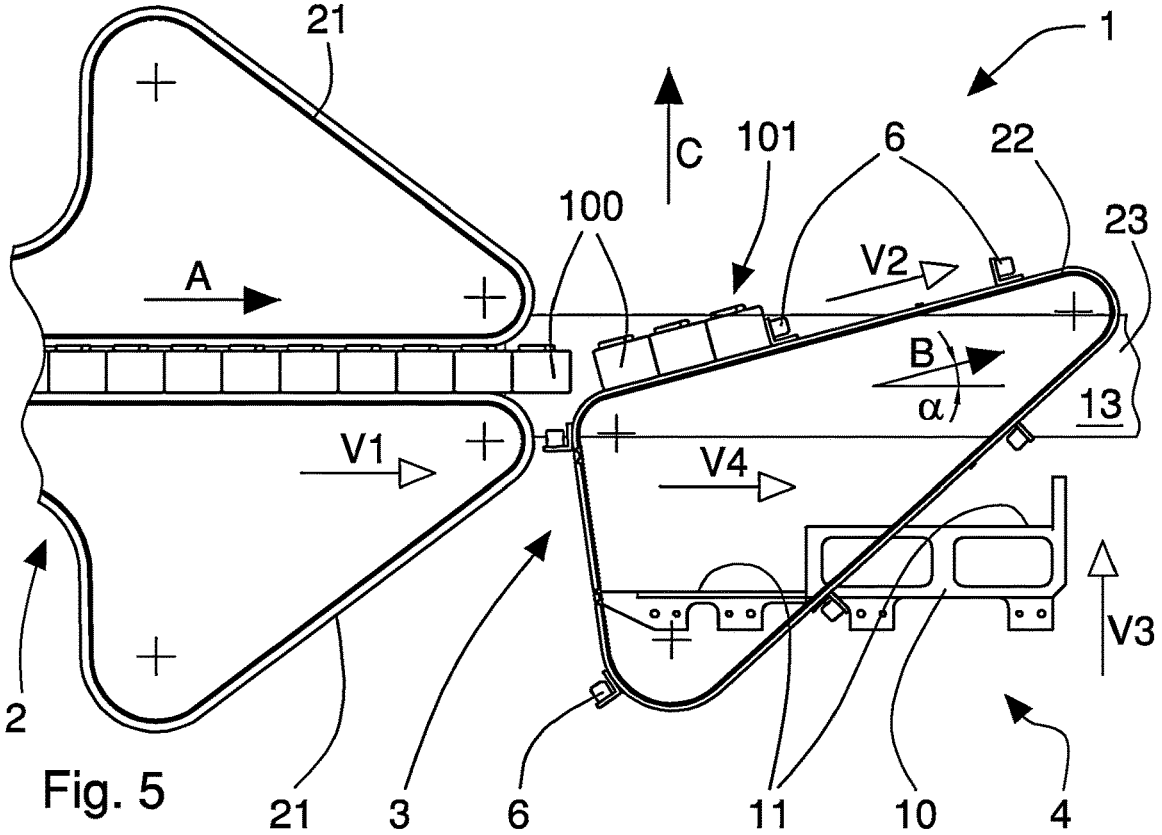
Fig. 5

Fig. 6
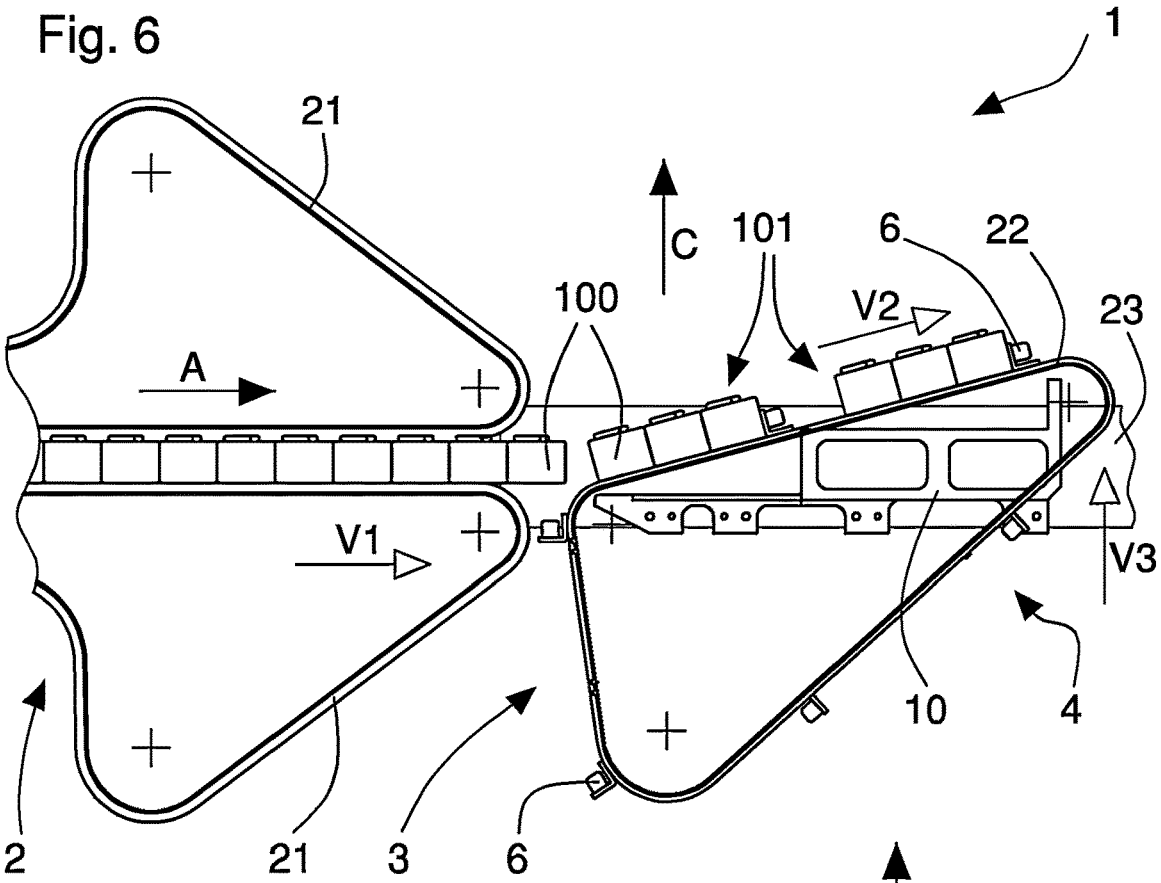
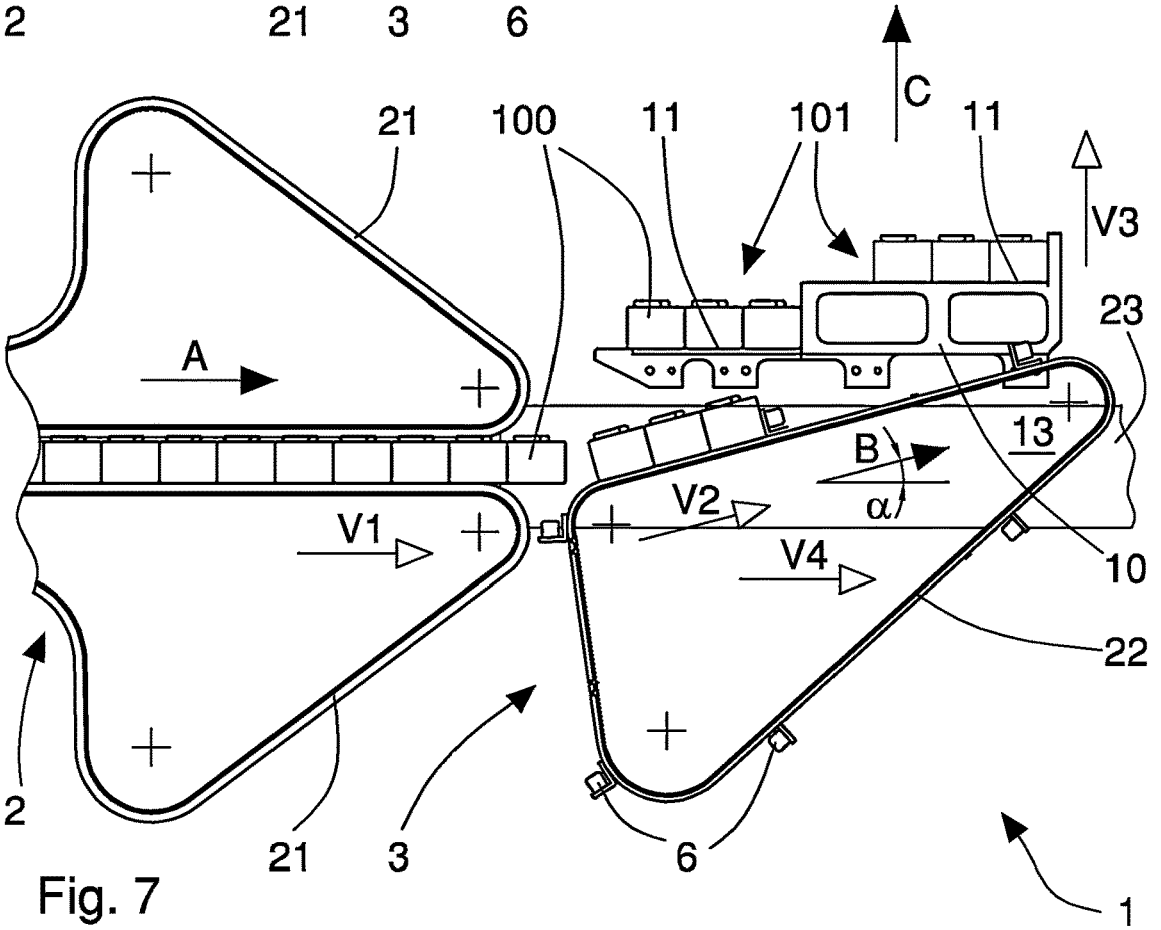
Fig. 7

Fig. 8
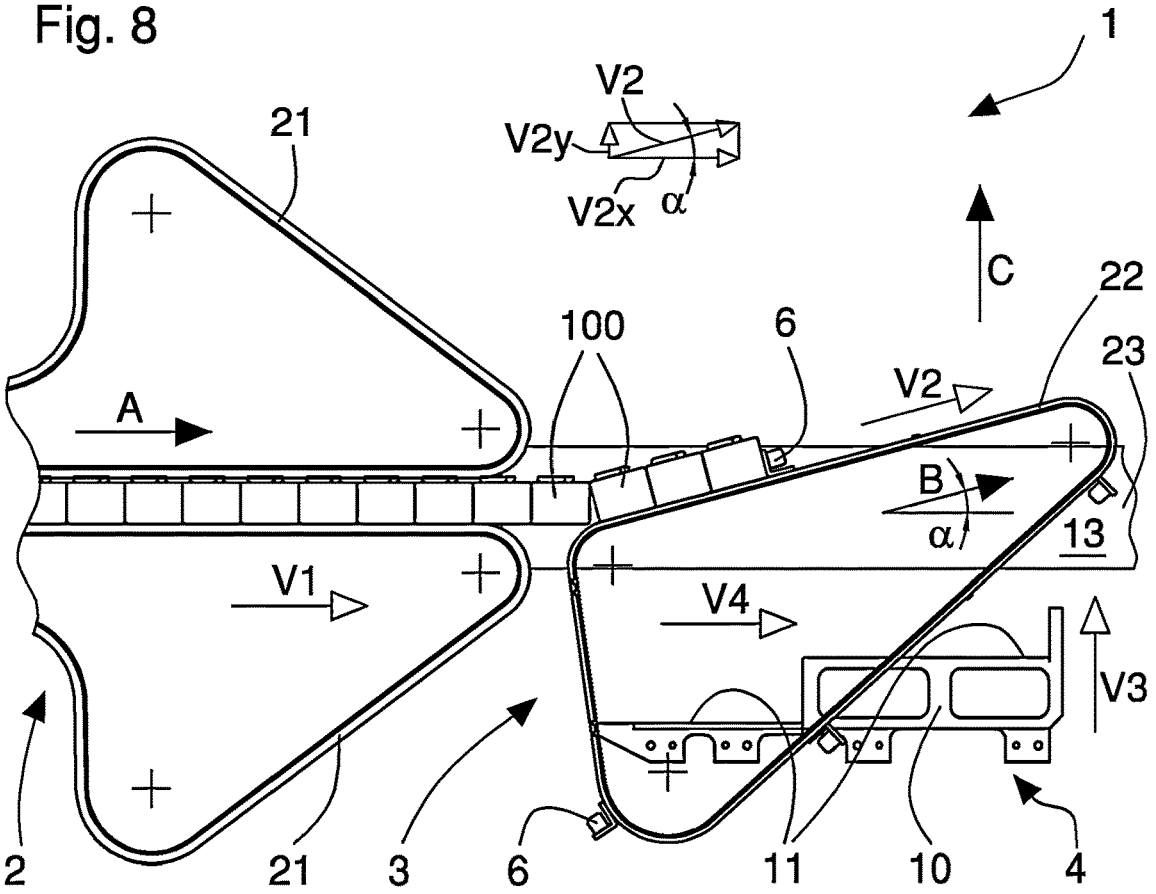
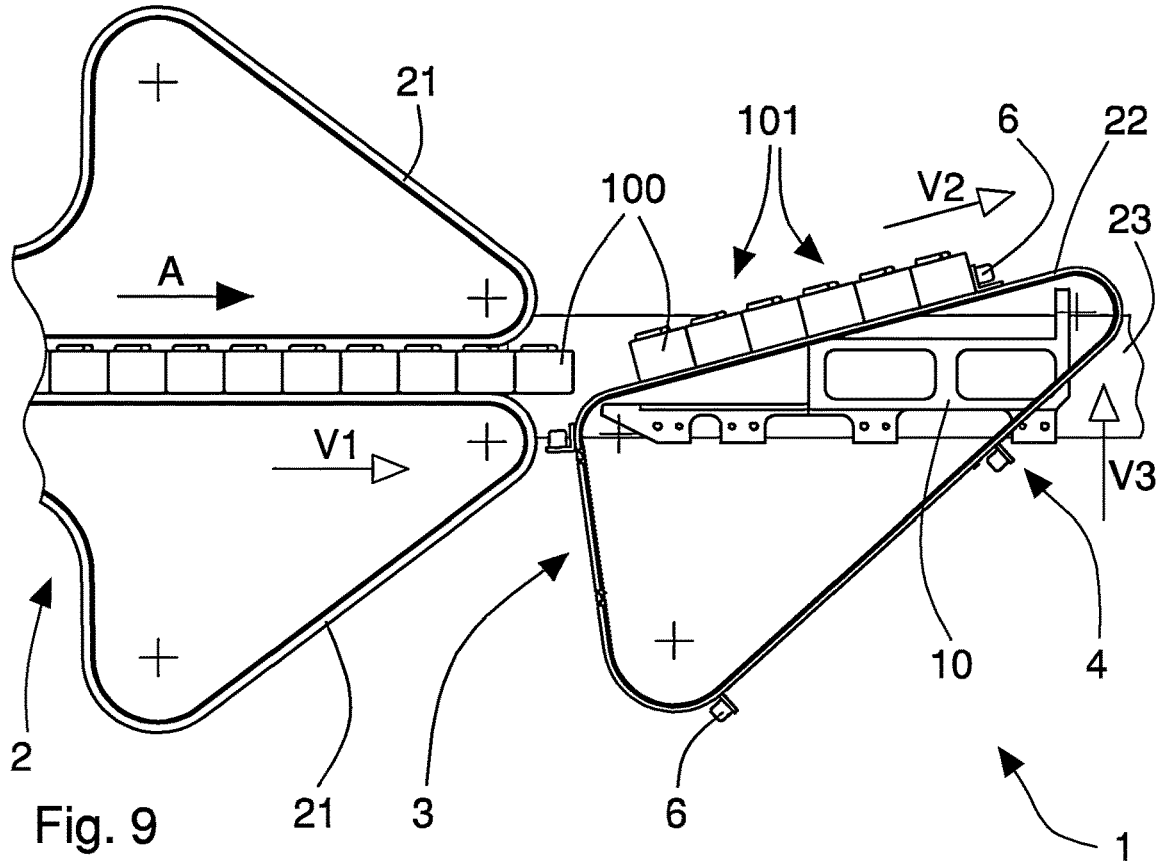
Fig. 9

APPARATUS AND METHOD FOR MOVING OBJECTS

The invention relates to apparatuses and methods for moving and transferring objects, typically in a packaging machine or plant. In particular, the invention relates to an apparatus and a method for making and linearly moving groups of objects arranged on parallel and spaced rows.

Moving apparatuses are known that are configured to pick up objects arranged aligned one after the other in contact along a first moving direction, arrange them grouped in parallel and spaced rows (each row consisting of a set number of objects) and then move said rows along a second moving direction, parallel or transverse to the first moving direction. Typically said moving apparatuses are intended for feeding a machine or an operating unit arranged downstream and configured, for example for packaging the groups or rows of objects.

Moving apparatuses are known which comprise a first inlet conveyor, which moves the objects arranged aligned and in contact one after the other towards a second conveyor, that is arranged at 90°, i.e., perpendicularly, with respect to the first conveyor and is configured to move the objects exiting the moving apparatus arranged on parallel and spaced rows. For this purpose, these apparatuses comprise one or more transfer elements adapted to transfer one group of objects at a time, formed by a defined number of objects, from the first conveyor to the second conveyor. The transfer element has an elongated shape, extends parallel to the first conveyor and is movable along a direction parallel to the second conveyor with continuous motion at constant speed.

However, such a type of apparatus is not suitable for operating at high speeds since the transfer element, when contacting and engaging the objects coming from the first conveyor, since it moves linearly, imposes on the aforesaid objects an abrupt change of trajectory (of 90°) which causes a stop of the objects along the direction of the first conveyor and a simultaneous high acceleration along the direction of the second conveyor. This sudden change of trajectory can cause instability and therefore the falling of objects on the supporting plane, especially at high moving speeds.

To overcome such a drawback, moving apparatuses are known in which the transfer element is also movable parallel to the first conveyor so as to abut and move the objects according to a motion trajectory composed along the two moving directions, which limits the decelerations and accelerations to which the objects are subjected, thus ensuring their stability.

However, such apparatuses are quite complex and expensive due to the double movement of the transfer element.

An object of the invention is to improve the known moving apparatuses and methods for making and linearly moving groups of objects of set number arranged on spaced parallel rows.

Another object is to provide a moving apparatus and a method which allow to precisely and efficiently pick up objects arranged aligned and in contact along a first advancement direction and to arrange said objects grouped in spaced parallel rows, moved along a second advancement direction, in particular orthogonal to the first advancement direction.

A further object is to make a moving apparatus capable of operating safely and reliably even at high moving speeds of objects.

A still further object is to provide a moving apparatus having simple and economical construction and precise and reliable operation.

In a first aspect of the invention, a moving apparatus according to claim 1 is provided.

In a second aspect of the invention, a method for moving objects according to claim 14 is provided.

The invention can be better understood and implemented with reference to the attached drawings which illustrate exemplifying and non-limiting embodiments thereof, in which:

FIGS. 4 to 7 are schematic partial plan views of the moving apparatus of FIG. 2 which illustrate subsequent operating steps for transferring and moving objects;

FIGS. 8 and 9 are schematic partial plan views of a variant of the moving apparatus of FIG. 2 which illustrate subsequent operating steps for transferring and moving objects.

Figure 1:
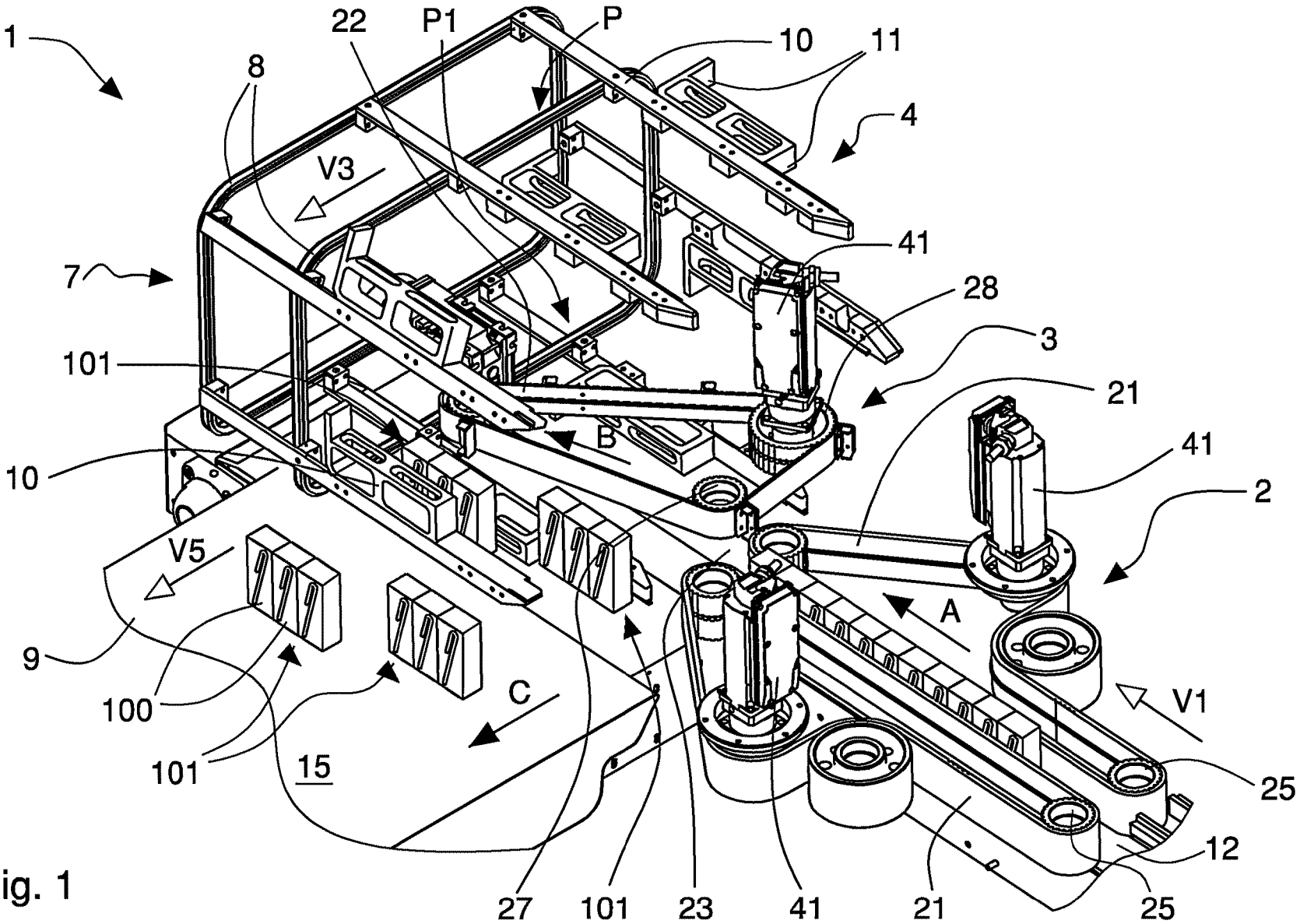
FIG. 1 is a partial perspective view of the moving apparatus of the invention in an operating configuration.

With reference to FIGS. 1 to 7, the moving apparatus 1 for objects 100 of the invention is illustrated, in particular configured to pick up objects 100 arranged aligned and in contact along a first advancement direction A and to arrange the objects grouped in spaced parallel rows, moved along a second advancement direction C which is transversal, in particular orthogonal, to the first advancement direction A.

The objects 100 are for example bottles, cans, jars or parallelepiped-shaped containers as illustrated in the figures.

The apparatus 1 comprises first moving means 2, configured to move and separate into groups 101 of set number N objects 100 arranged aligned and in contact with each other along the first advancement direction A, and second moving means 3, arranged to receive the groups 101 of objects from the first moving means 2 and move the groups separately along a transfer direction B that is inclined by an angle $\alpha$ with respect to the first advancement direction A. The angle $\alpha$ is comprised between 5° and 25°, in particular equal to approximately 15°.

More precisely, the first moving means 2 comprise at least one first moving belt 21 arranged to abut the objects 100 arranged aligned and in contact with each other along the first advancement direction A on an advancement plane 12 and mobile with intermittent motion so as to move the objects 100 along the first advancement direction A at a first speed V1 and so as to separate said objects 100 into groups 101 of a set number N. In particular, said first moving belt 21 is arranged to abut a side wall, in particular vertical, of said objects 100.

The second moving means 3 comprise a second moving belt 22 also arranged to abut the objects 100 and suitable to separately move the groups 101 of objects received from the first moving means 2 with continuous motion at a second speed V2, in particular constant, along the transfer direction B, said groups 101 of objects being supported by, and movable on, a first moving plane 13 that is coplanar with the advancement plane 12. In particular, said second moving belt 22 is arranged to abut a side wall, in particular vertical, of said objects 100.

The moving apparatus 1 also comprises third moving means 4 which include at least one transfer element 10 movable along the second advancement direction C. The transfer element 10 is arranged to abut and pick up at least one group 101 of objects at a time from the second moving means 3 and then move the aforesaid group 101 of objects along the second advancement direction C with the corresponding objects 100 arranged in a row, i.e., arranged one adjacent to the other in contact and aligned orthogonally to the second advancement direction C, on a supporting plane 16 that is coplanar with the advancement plane 12 and the first moving plane 13.

Figures 2, 3:
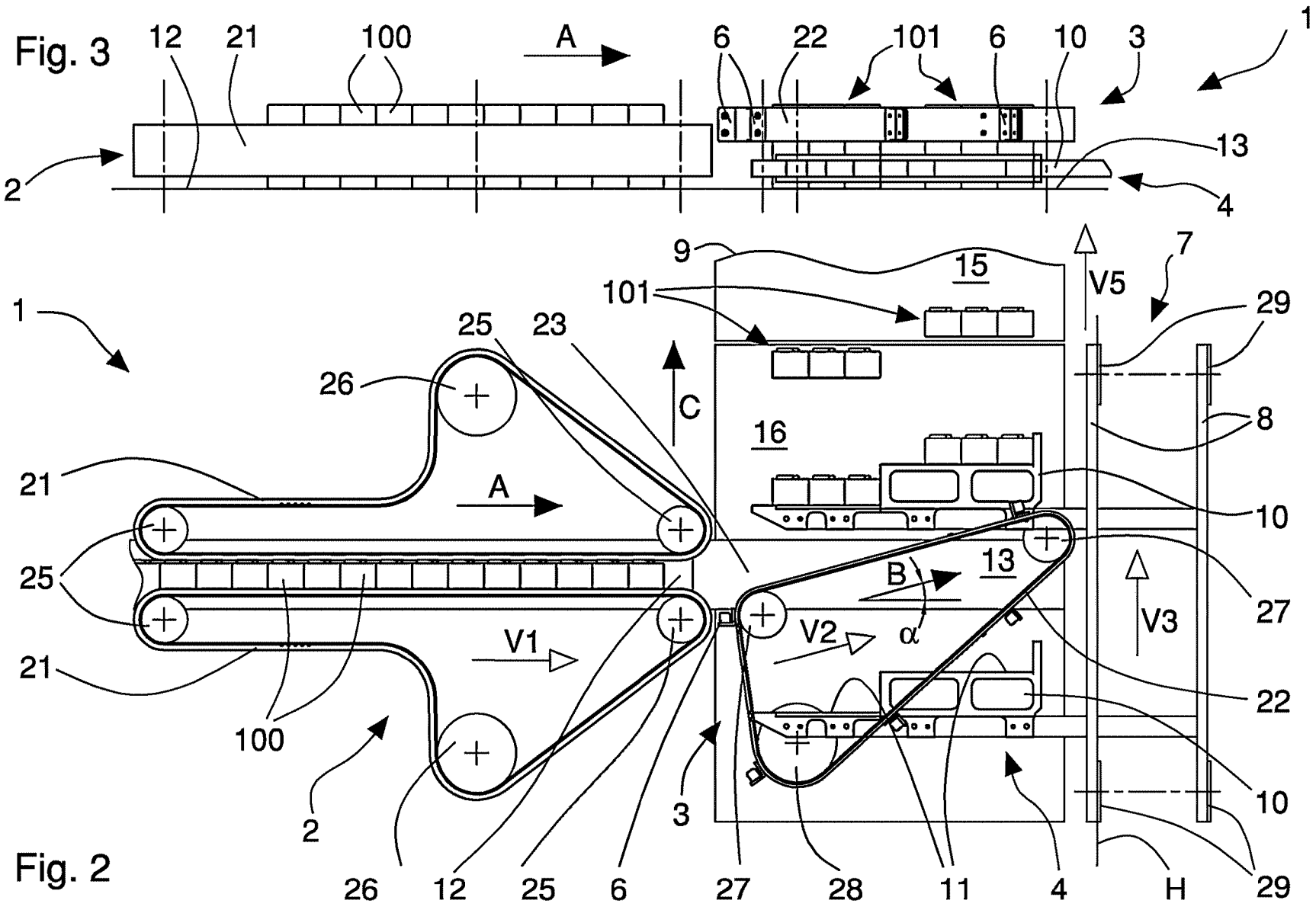
FIG. 2 is a plan schematic view of the moving apparatus of FIG. 1.
FIG. 3 is a front view of the moving apparatus of FIG. 2.

As illustrated in particular in FIG. 2, the transfer direction B is inclined towards the second advancement direction C.

The moving apparatus 1 further comprises supporting means 7 suitable to support and move the at least one transfer element 10 along a closed curvilinear path P having a first straight operating section P1 along which the transfer element 10 is movable along the second advancement direction C.

In the embodiment shown in FIGS. 1 to 7, the groups 101 of objects comprise a number N of objects 100 equal to three, which are separated from the first moving means 2 and transferred to the second moving means 3. The number N of objects 100 forming a group 101 can obviously also be less than or greater than three, selectable based on the size of the object 100 itself and the needs of the user.

In the illustrated embodiment the first moving means 2 comprise a pair of first moving chains or belts 21 parallel and opposite and configured to abut the objects 100 on opposite sides and move them along the first advancement direction A. More precisely, the first belts 21 abut vertical side walls of the objects 100 and are driven so as to drag and move the objects. The first moving means 2 are driven with intermittent motion along the first advancement direction A so as to separate and provide a defined number of objects 100 forming at least one group 101 to the second moving means 3 at each moving step of the intermittent motion. The first moving means 2 move the objects 100 with the first speed V1 (average speed during the moving step) which is in particular adjustable.

The first moving belts 21 are, for example, endless toothed belts and are mounted on first and second pulleys 25, 26 which are also toothed and rotatable about vertical axes. More precisely, the first moving belts 21 are mounted mirrored with respect to a vertical plane parallel to the first advancement direction A. Each first moving belt 21 is operated by a respective actuator 41, for example a rotary electric motor, acting on a second drive pulley 26 so as to move at the first speed V1.

In a variant of the moving apparatus 1 not illustrated in the figures, the first moving means 2 can comprise a single first moving belt 21 configured to abut one side of the objects 100 and to move them along the first advancement direction A. In this case, the moving apparatus 1 comprises a guide arranged facing and opposite the first moving belt 21 and cooperating with the latter to guide the objects 100 along the first advancement direction A.

The second moving means 3, i.e. the second moving belt 22, are movable with continuous motion at the second speed V2, in particular also substantially constant and adjustable.

The second moving belt 22 is for example an endless toothed belt and is mounted on third and fourth pulleys 27, 28 which are also toothed and rotatable about their respective vertical axes. The second moving belt 22 is operated by a respective actuator 41, for example an electric rotary motor, acting on the fourth driving pulley 28.

In the embodiment shown in the figures, the second belt 22 is provided with at least one stop tooth 6 configured to abut and retain at least one group 101 of objects exiting the first moving means 2. More precisely, the first object 100 of a group 101 of objects exiting at each moving step from the first moving belts 21 abuts and engages the stop tooth 6, which acts as a reference for the correct positioning of the object 100 (and of the group 101 of objects) on the second moving belt 22 so as to ensure a subsequent correct picking up of the group 101 by the transfer element 10.

The stop tooth 6 also provides a stabilizing support to the objects 100 which prevents them from falling during movement.

In the embodiment shown in FIGS. 1 to 7, the second belt 22 comprises a plurality of stop teeth 6 regularly spaced from each other along the extension length of the aforesaid second belt 22 at a distance which allows each stop tooth 6 to abut only one group 101 of objects at a time exiting the first moving means 2.

Alternatively, as illustrated in the variant of the moving apparatus 1 of FIGS. 8 and 9, the second belt 22 can comprise a smaller number of stop teeth 6 regularly spaced from one another by a distance which allows each stop tooth 6 to abut a plurality of groups 101 of objects at a time, for example two, exiting the first moving means 2. In this case, during each moving step of intermittent motion the first moving means 2 move and transfer said set plurality of groups 101 of objects to the second moving means 3.

In another variant of the moving apparatus 1 of the invention not illustrated, the second moving belt 22 lacks stop teeth 6.

The moving apparatus comprises fourth moving means 23 interposed between first moving means 2 and second moving means 3 and configured to cooperate to transfer the groups 101 of objects from the first moving means 4 to the second moving means 3. The fourth moving means 23 are movable with continuous motion at a fourth speed V4, in particular adjustable, parallel to the first advancement direction A and comprise a respective transport belt defining the first moving plane 13 for the groups 101 of objects.

The fourth speed V4 is in particular equal to or higher than the first speed V1 of the first moving means 2 and higher than the second speed V2 of the second moving means 3.

Thereby, as better explained in the following description, the fourth moving means 23 ensure that the first object 100 of a group 101 of objects exiting the first moving belts 21 abuts and stops against a stop tooth 6 of the second moving belt 22.

The transfer element 10 of the third moving means 4 has an elongated shape and extends transversally, in particular almost orthogonally, to the second advancement direction C.

The transfer element 10 comprises at least one seat 11 suitable to receive and retain a group 101 of objects picked up from the second moving means 3. In the illustrated embodiment the transfer element 10 comprises a plurality of seats 11, for example two, adapted to receive respective groups 101 of objects from the second moving means 3, to be moved together along the second advancement direction C.

In particular, the seats 11 of the transfer element are adjacent and side by side along a direction parallel to the first advancement direction A and staggered along a direction parallel to the second advancement direction C. More precisely, the seat 11 farthest from the first moving means 2 is more advanced along the second advancement direction C with respect to the adjacent seat 11 that is closest to the first moving means 2.

Each seat 11 comprises a first wall 11*a* and a second wall 11*b* substantially orthogonal to the supporting plane 16. The first wall 11*a*, orthogonal to the second advancement direction C, is configured to abut the side walls of the objects 100 of the respective group 101, while the second wall 11*b*, parallel to the second advancement direction C, is configured to abut the first object group 101, i.e., the head object of the group 101 of objects.

Thanks to the seats 11 of the transfer element 10, the groups 101 of objects are picked up from the second moving belt 22 of the second moving means 3 and guided in a precise and stable manner along the second advancement direction C. In particular, each transfer element 10 picks up and moves two groups 101 of objects forming two rows of parallel and staggered objects 100.

Each transfer element 10 is movable with continuous motion at a third speed V3 along the second advancement direction C.

The curvilinear path P along which each transfer element 10 is moved by the supporting means 7 extends on a movement plane H that is parallel to the second advancement direction C and perpendicular to the supporting plane 16.

The supporting means 7 comprise, for example, one or more endless driving chains or belts 8, for example two, mounted on respective pulleys 29 rotatable about horizontal axes. In the illustrated embodiment, the supporting means 7 comprise a pair of driving chains 8 parallel to each other and to the movement plane H.

Each transfer element 10 is cantilevered mounted on the driving chains 8.

The transfer elements 10 are mounted regularly spaced apart on the supporting means 7.

The moving apparatus 1 further comprises fifth moving means 9 positioned downstream of the third moving means 4 and arranged to receive from the third moving means the groups 101 of objects arranged on parallel and spaced rows and then move the groups along the second advancement direction C.

The fifth moving means 9 are movable with continuous motion at a fifth speed V5, in particular almost equal to or slightly lower than the third speed V3 at which third moving means 4 move. Thereby, the transfer of groups 101 of objects from the third moving means 4 to the fifth moving means 9 occurs without the objects 100 undergoing accelerations or decelerations, this ensuring their stability and balance.

The fifth moving means 9 comprise, for example, a respective transport belt forming a second moving plane 15 for the groups 101 of objects. The second moving plane 15 is coplanar with the advancement plane 12, the first moving plane 13 and the supporting plane 16.

The operation of the moving apparatus 1 of the invention provides that the objects 100 are arranged aligned one behind the other in contact to form a single row within the first moving means 2, driven with intermittent motion. More precisely, the first moving belts 21, which abut the objects 100 on opposite sides, move the objects along the first advancement direction A during the moving steps of the intermittent motion.

With reference to the embodiment of FIGS. 1 to 7, during each moving step of the intermittent motion, the first moving belts 21 at an exit end thereof separate and push a respective group 101 of objects towards the second moving means 3, the group being formed by a set number N of objects 100, for example three.

The groups 101 of objects are moved out of the first moving means 2 also by the fourth moving means 23.

The second moving belt 22 of the second moving means 3 receives and abuts the objects, deviating their path and moving them along the transfer direction B with the second speed V2. Each group 101 of objects is abutted by a respective stop tooth 6 fixed to the second moving belt 22.

The first object 100 of a group 101 of objects exiting the first moving belts 21 abuts the stop tooth 6 of the second moving belt 22 also thank to fourth moving means 23, which move the groups 101 of objects along the first advancement direction A with a fourth speed V4 higher than the second speed V2.

The stop tooth 6 serves as a reference for the correct positioning of the group 101 of objects on the second moving belt 22 so as to ensure the group 101 to be subsequently correctly picked up by the transfer element 10. More specifically, the second moving belt 22 moves and progressively inserts the objects of a group 101 of objects into a respective seat 11 of the moving element 10.

It should be noted that since the transfer direction B is inclined towards the second advancement direction C of the angle $\alpha$ with respect to the first advancement direction A, the objects 100, moved by the second moving belt 22, are subject to a first speed component $V2x=V2 \cos \alpha$, parallel to the first advancement direction A, and to a second speed component $V2y=V2 \sin \alpha$, parallel to the second advancement direction C (FIG. 4). The first speed component V2x is lower than the first moving speed V1 of the first moving means 2, i.e., of the first moving belts 21, and the second speed component V2y is lower than the third moving speed V3 of the transfer element 10.

Therefore, the second belt 22 on the one hand slows the objects 100 along the first advancement direction A, before they stop against the second wall 11*b* of a seat 11 of the transfer element 10 (perpendicular to said first advancement direction A), on the other hand they accelerate and move the objects 100 along the second advancement direction C before they are abutted by the first wall 11*a* of the seat 11 of the transfer element 10.

Thanks to the second moving belt 22, the amount of impacts of the objects 100 against the transfer element 10 is therefore reduced, this ensuring greater stability to the objects 100 while they are moved and reducing the risk of them falling.

The transfer elements 10, which are mobile with continuous motion along the second advancement direction C, pick up two groups 101 of objects from the second moving belt 22 and transfer them, by sliding them over the supporting plane 16, on the second moving plane 15 of the fifth moving means 9.

Since the transport belt of fifth moving means 9 is movable with continuous motion at a fifth speed V5 almost equal to, or slightly lower than, the third speed V3 at which the transfer elements 10 are moved, the groups 101 of objects are transferred from the third moving means 4 to the fifth moving means 9 without the objects 100 undergoing accelerations or decelerations, this ensuring their stability and balance.

With particular reference to FIGS. 8 and 9, the operation of the variant of the moving apparatus comprising a second belt 22 having a smaller number of stop teeth 6 provides that the first moving means 2 during each moving step of the intermittent motion separate and push a plurality of groups 101 of objects (for example two in the example illustrated), in particular in number equal to the number of seats 11 (for example two) present on each transfer element 10, along the first advancement direction A towards the second moving means 3 (assisted by the fourth moving means 23). Each group 101 of objects is formed by a set number N of objects 100, for example three, whereby the first moving means 2 separate and push a total of six objects 100 in each moving step, which are received and abutted by the second moving means 3 which deviate the trajectory of said objects.

The two groups 101 of objects moved by the second moving belt 22 are abutted in succession and separately by the transfer element 10, each group 101 being housed in a respective seat 11 of the transfer element 10.

The method of the invention for moving objects comprises the following steps:

moving on an advancement plane 12 objects 100 arranged aligned one behind the other and in contact along a first advancement direction A with intermittent motion at a first speed V1 so as to separate and form groups 101 of set number N of objects 100 at each moving step of said intermittent motion;

receiving at least one group 101 of objects at a time and then moving the group on a first moving plane 13 along a transfer direction B, which is inclined by an angle α with respect to the first advancement direction A, with continuous motion at a second speed V2, the first moving plane 13 being coplanar to advancement plane 12;

abutting and picking up at least one group 101 of objects at a time and moving the group with continuous motion at a third speed V3 on a supporting plane 16 along a second advancement direction C that is transverse, in particular almost orthogonal, to the first advancement direction A, said at least one group 101 comprising objects 100 arranged in a row in contact, in particular aligned perpendicularly to the second advancement direction C, the supporting plane 16 being coplanar with the first moving plane 13 and the advancement plane 12.

The method further comprises abutting, picking up and moving together a plurality of groups 101 of separate objects along the second advancement direction C.

The method further provides that the second speed V2 along the transfer direction B comprises a first speed component V2x parallel to the first advancement direction A and a second speed component V2y parallel to the second advancement direction C. The first speed component V2x is lower than the first moving speed V1 of the first moving means 2 and the second speed component V2y is lower than the third moving speed V3 of the transfer element 10.

Thanks to the moving apparatus 1 and the method for moving objects of the invention it is therefore possible to accurately and efficiently pick up objects 100 arranged aligned and in contact along a first advancement direction A and arrange said objects in groups 101 in parallel and spaced rows, which are moved along a second advancement direction C, orthogonal to the first advancement direction A.

In particular, thanks to the second moving means 3, which transfer the objects 100 along the transfer direction B that is inclined by an angle α, in particular equal to 15°, with respect to the first advancement direction A, it is possible to reduce decelerations and accelerations acting on the objects 100 when they are abutted, picked up and moved by the transfer elements 10 of the third moving means 4 along the second advancement direction C.

The moving apparatus 1 is therefore capable of operating also at high moving speeds (speed V1, V2, V3, V4, V5) of the objects 100 in a safe and reliable manner.

Thanks to the use of respective moving belts and transport belts to make the moving means 2, 3, 4, 9, 23 for moving objects 100 and groups 101 of objects, the moving apparatus 1 of the invention is of simple and economical construction and has precise and reliable operation.

The invention claimed is:

1. A moving apparatus for objects, the moving apparatus comprising:

a first moving system comprising at least one first moving belt configured to abut the objects arranged aligned one behind another and in contact along a first advancement direction on an advancement plane, said at least one first moving belt being mobile with intermittent motion in order to move along the first advancement direction at a first speed the objects and to separate the objects in groups of a set number;

a second moving system comprising a second moving belt arranged to abut the objects, said second moving system being arranged to receive the groups of objects from said first moving system and move the groups separately on a first moving plane, which is coplanar to the advancement plane, with continuous motion at a second speed along a transfer direction that is inclined by an angle with respect to the first advancement direction;

a third moving system comprising at least one transfer element that is mobile with continuous motion at a third speed along a second advancement direction, which is transversal to the first advancement direction, and is arranged to abut and pick up at least one group of objects at a time from said second moving system and then move along the second advancement direction the at least one group of objects arranged in a row on a supporting plane that is coplanar to the advancement plane and the first moving plane; and supporting arrangement suitable to support and move said at least one transfer element along a closed curvilinear path having a first operating section along which said at least one transfer element is movable along the second advancement direction.

2. The moving apparatus according to claim 1, wherein said at least one first moving belt is arranged to abut a side wall of the objects so as to move the objects along the first advancement direction.

3. The moving apparatus according to claim 1, wherein said first moving system comprises a pair of first movement belts parallel and opposite each other and configured to abut opposite side walls of the objects and move the objects along the first advancement direction.

4. The moving apparatus according to claim 1, wherein said second moving belt is arranged to abut a side wall of the objects and is provided with at least one stop tooth suitable for abutting and retaining at least one group of objects coming out from said first moving system.

5. The moving apparatus according to claim 1, wherein said at least one first moving belt and said second moving belt are endless belts and are mounted on respective pulleys rotatable about vertical axes.

6. The moving apparatus according to claim 1, wherein the angle is between 5° and 25°.

7. The moving apparatus according to claim 1, further comprising a fourth moving system interposed between said first moving system and said second moving system and configured to cooperate in transferring the groups of objects from said first moving system to said second moving system.

8. The moving apparatus according to claim 7, wherein said fourth moving system is movable with continuous motion, parallel to the first advancement direction at a fourth speed and comprises a respective transport belt that forms the first moving plane for the groups of objects.

9. The moving apparatus according to claim 8, wherein the fourth speed is higher than the second speed.

10. The moving apparatus according to claim 1, wherein said at least one transfer element has an elongated shape and extends transversely to the second advancement direction, said at least one transfer element comprising at least one seat suitable for receiving and retaining a group of objects moved by said second moving system.

11. The moving apparatus according to claim 10, wherein said at least one transfer element comprises a plurality of seats suitable to receive respective groups of objects to be moved together along the second advancement direction.

12. The moving apparatus according to claim 11, wherein said plurality of seats are positioned side by side along a direction parallel to the first advancement direction and staggered along a direction parallel to the second advancement direction.

13. The moving apparatus according to claim 1, wherein said supporting means comprises at least one endless driving chain mounted on respective pulleys rotatable about horizontal axes, said at least one transfer element being cantilevered mounted on said at least one endless driving chain.

14. The moving apparatus according to claim 1, wherein said at least one transfer element is a plurality of transfer elements mounted spaced apart on said supporting means.

15. The moving apparatus according to claim 1, further comprising a fifth moving system positioned downstream of said third moving system and arranged to receive from said third moving system the groups of objects arranged on parallel and spaced rows and moving the groups along the second advancement direction.

16. The moving apparatus according to claim 15, wherein said fifth moving system is mobile with continuous motion at a fifth speed and includes a transport belt forming a second moving plane for the groups of objects, the second moving plane being coplanar to the advancement plane, the first moving plane and the supporting plane, and wherein the fifth speed is substantially equal to the third speed of said third moving system.

17. The moving apparatus according to claim 1, wherein the angle is equal to about 15°.

18. A method for moving objects, the method comprising:

moving on an advancement plane objects arranged aligned one behind another and in contact along a first advancement direction with intermittent motion at a first speed so as to separate and form at each moving step of the intermittent motion groups of a set number of objects;

receiving at least one group of objects at a time and moving the group of objects on a first moving plane along a transfer direction that is inclined by an angle with respect to the first advancement direction with continuous motion at a second speed, the first moving plane being coplanar to the advancement plane; and abutting and picking up the at least one group of objects at a time and moving the group with continuous motion at a third speed on a supporting plane along a second advancement direction transversal to the first advancement direction, the at least one group of objects comprising objects arranged in contact to each other in a row, the supporting plane being coplanar to the first moving plane and the advancement plane.

19. The method according to claim 18, further comprising abutting, picking up and moving together along the second advancement direction a plurality of groups of objects.

20. The method according to claim 18, wherein the second speed along the transfer direction comprises a first speed component that is parallel to the first advancement direction and a second speed component that is parallel to the second advancement direction, and wherein the first speed component is lower than the first speed of a first moving system and the second speed component is lower than the third speed of a transfer element.

* * * * *